US006363978B2

(12) United States Patent
Castillo

(10) Patent No.: US 6,363,978 B2
(45) Date of Patent: Apr. 2, 2002

(54) CAN CONTAINER DEVICE FOR MAINTAINING SEPARATE INGREDIENTS IN LIQUID FOOD PRODUCTS

(76) Inventor: James A. Castillo, 1848 Kahakai Dr., #1506, Honolulu, HI (US) 96814

( * ) Notice: Subject to any disclaimer, the term of this patent is extended or adjusted under 35 U.S.C. 154(b) by 0 days.

(21) Appl. No.: 09/788,764

(22) Filed: Feb. 21, 2001

Related U.S. Application Data

(62) Division of application No. 09/321,676, filed on May 28, 1999, now Pat. No. 6,250,346.

(51) Int. Cl.[7] ..... B65B 1/04; B65B 3/04; B67C 3/02

(52) U.S. Cl. ..... 141/100; 141/104; 141/110; 141/363; 141/366; 206/219; 206/222; 215/6; 215/46

(58) Field of Search ..... 141/18, 100, 104, 141/110–112, 114, 363, 364, 366, 390; 206/216, 222; 220/23.87, 23.88, 23.89, 269, 528; 215/6, 46

(56) References Cited

U.S. PATENT DOCUMENTS

| | | | | |
|---|---|---|---|---|
| 3,179,275 A | | 4/1965 | Roskam | |
| 3,225,915 A | | 12/1965 | Wise | |
| 4,264,007 A | | 4/1971 | Hunt | |
| 3,779,372 A | | 12/1973 | de Lloret | |
| 3,866,800 A | * | 2/1975 | Schmitt | 222/94 |
| 3,876,112 A | * | 4/1975 | Kramer | 222/132 |
| 4,024,952 A | | 5/1977 | Leitz | |
| 4,221,291 A | | 9/1980 | Hunt | |
| 4,618,444 A | | 10/1986 | Hudson | |
| 4,919,295 A | * | 4/1990 | Hitzler | 220/23.83 |
| 5,064,073 A | | 11/1991 | Folland | |
| 5,114,011 A | | 5/1992 | Robbins, III | |
| 5,215,214 A | * | 6/1993 | Lev et al. | 222/1 |
| 5,431,276 A | | 7/1995 | Lialin | |
| 5,529,179 A | | 6/1996 | Hanson | |
| 5,836,479 A | * | 11/1998 | Klima et al. | 222/83.5 |
| 5,848,730 A | * | 12/1998 | Kawase et al. | 222/94 |
| 5,885,635 A | | 3/1999 | Spring et al. | |

* cited by examiner

*Primary Examiner*—Timothy L. Maust
(74) *Attorney, Agent, or Firm*—Leighton K. Chong

(57) ABSTRACT

A device for maintaining ingredients separately within a bottle container of the type having a removable container cap has a sub-container body formed with squeezable plastic outer walls and inner divider walls forming multiple compartments having respective orifices for dispensing the ingredients contained therein. Each compartment can be separately opened (by removing a sealing element) and its ingredient can be dispensed into the container by squeezing. A can container having a fixed can top and pull tab, has a one or more sub-container vessels held in exterior well(s) recessed in the surface of the container top, and held in place by and protected by the pull tab. When the pull tab is removed and the tab opening is exposed, the sub-container vessel(s) can be removed from the exterior well(s) to dispense their separate ingredients into the container. These improved devices allow multiple ingredients to be safely stored separately from the carrier liquid and conveniently used and controllably metered to the user's tastes.

5 Claims, 16 Drawing Sheets

FIG. 7A
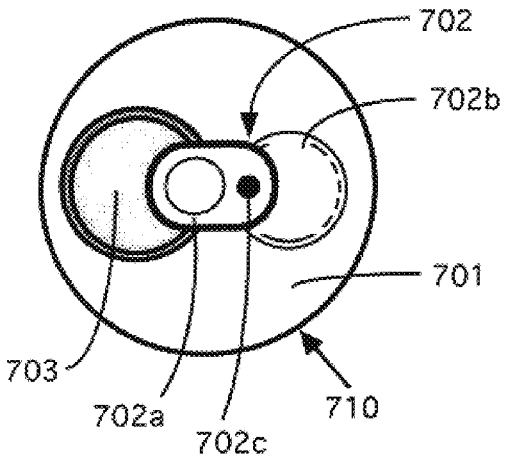
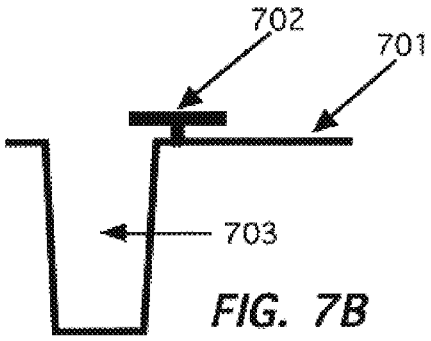
FIG. 7B
FIG. 7C
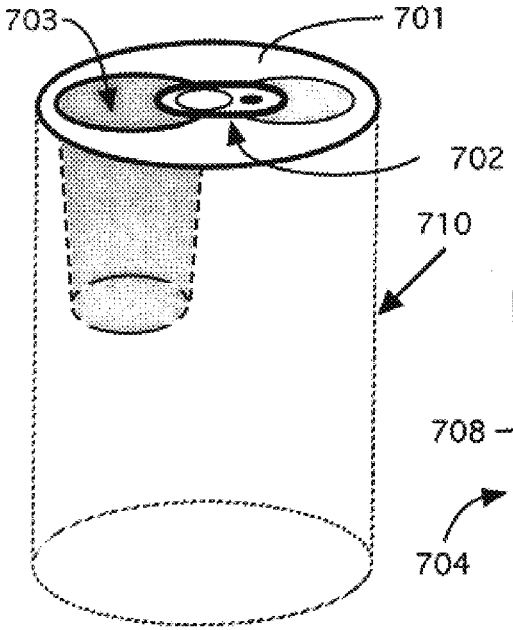
FIG. 7D
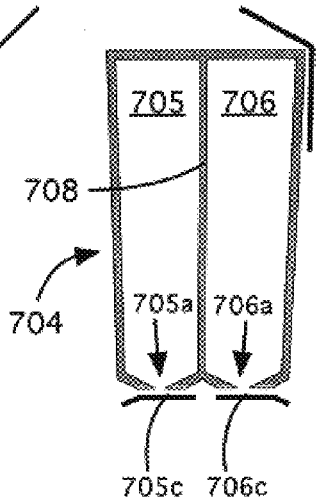
FIG. 7E
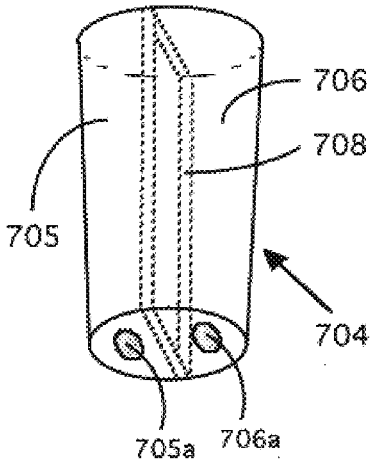

CAN CONTAINER DEVICE FOR MAINTAINING SEPARATE INGREDIENTS IN LIQUID FOOD PRODUCTS

This is a divisional application claiming the priority of U.S. patent application Ser. No. 09/321,676, filed by the same inventor on May 28, 1999, entitled DEVICE FOR MAINTAINING SEPARATE INGREDIENTS IN LIQUID FOOD PRODUCTS, which has issued as U.S. Pat. No. 6,250,346 on Jun. 26, 2001.

TECHNICAL FIELD

This invention generally relates to a device for maintaining ingredients separate in liquid food products until the time of use, and more particularly, to such improvements as used with standard beverage bottles or cans.

BACKGROUND OF INVENTION

In the storage of liquid foodstuffs, and particularly beverages, the food product can have better flavor, have a longer shelf life, be made without preservatives, and/or can use less stable or unstable ingredients if certain of the ingredients can be stored separately from the carrier liquid until the food product is to be consumed. For example, a beverage can have better taste if the flavoring can be stored in dry form and mixed with the carrier liquid just prior to use. Some flavorings, oils, vitamins, supplements, medicines, and other ingredients when mixed with water, soda, or other liquid media are unstable, and therefore may not be used with currently sold beverages and liquid mixtures. Oxygenated water is known to have health benefits but is chemically reactive, and therefore flavors, vitamins, supplements, and pharmaceuticals cannot be combined with it in a stored product. Many beverages, sauces, and condiments require high levels of preservatives to control fermentation with sugar content.

Prior devices have been proposed for storing ingredients separately from the carrier liquid until the product is to be used, however they have a number of disadvantages. Some devices, as shown in U.S. Pat. Nos. 3,779,372, 5,529,179, 5,431,276, and 5,885,635, for example, have a burstable compartment attached to the underside of the container lid or cap which is burst open to mix ingredients into the carrier liquid by levering a puncturing tab or depressing a plunger element with an applied pressure. However, these devices may be unsafe or messy to use since a high applied pressure must be used to burst open the compartment, and may cause the ingredients spew out it of the container or back toward the user.

Other devices, such as shown in U.S. Pat. Nos. 3,179,275 3,225,915, or 5,064,073, for example, have a sub-compartment formed in the container top or held in the container neck with can be accessed by removing an outer seal strip, flap, or membrane. However, these devices are not suitable for the current vending machine environment, since the outer sealing member can become accidentally dislodged or punctured during transport or handling.

Some devices, such as shown in U.S. Pat. Nos. 4,024,952, 4,221,291 and 4,264,007, for example, have one or more sub-compartments formed inside the container on the underside of the container lid or cap which have a tilting or gate type element that is actuated by releasing or applying pressure to a component from the outside of the container lid or cap. These types of devices have the disadvantage that the ingredients are completely discharged into the liquid upon release, and cannot be metered or controllably added to the liquid according to the tastes of the user.

Another device, such as shown in U.S. Pat. No. 5,114,011, for example, has a removable sub-container with removable seal which rests in the container neck covered by the container cap until it is ready to be used. However, this type of device has only a single compartment and does not have provision for easily metering ingredients into the container after the seal is opened.

Other types of devices, as shown in U.S. Pat. No. 5,114,011, for example, have a sub-container formed with one or more sub-compartments which is mounted to the underside of the container cap. However, the sub-compartments in these devices are disposed at opposite ends of the sub-container element and are opened by threaded elements, thereby making them costly to fabricate and awkward to use.

SUMMARY OF INVENTION

The present invention seeks to overcome the disadvantages and shortcomings of the prior devices by providing improved structures for holding ingredients separately within a container which is inexpensive to manufacture, convenient and easy to use, and prevents accidental unsealing or release during shipping or handling.

In a third embodiment, the device comprises a sub-container body in cylindrical form having a proximate end mounted to a collar adapted to be held on a neck of the container by the container cap, said sub-container body having at least one inner divider wall aligned in parallel with a cylinder axis of the sub-container body dividing the interior of the sub-container body into a plurality of axially oriented compartments, wherein each compartment has a dispensing orifice formed at a distal end of the sub-container body and an ingredient contained in the compartment is controllably dispensed through the orifice by removing the sub-container body from the container neck and squeezing on a part of the squeezable plastic outer walls corresponding to the compartment.

In the above-described embodiments, predetermined portions of the squeezable plastic outer walls corresponding to the respective compartments are formed with an area of lesser wall thickness than that of surrounding portions of the outer walls, such that the thinner wall areas can be squeezed more readily to dispense ingredients from the respective compartments.

In a fourth embodiment, the device comprises a sub-container body in cylindrical form having a proximate end mounted to an underside of the container cap, and at least one inner divider wall aligned transverse to a cylinder axis of the sub-container body dividing the interior of the sub-container body into a plurality of transversely oriented compartments, wherein each compartment has a dispensing orifice formed at a predetermined position of the outer walls and an ingredient contained in the compartment is controllably dispensed through the orifice by squeezing on a part of the outer walls corresponding to the compartment opposite from the orifice.

In accordance with a one can container embodiment of the invention for use with a container having a fixed container top and a pull-tab with a pull portion, a tab portion removably covering a tab opening in the container top, and a center fixture detachably mounted to an outer surface of the container top, the device comprises the container top being formed with a plurality of exterior wells positioned on radially spaced sides from the pull tab and recessed into the outer surface of the container top, said exterior wells having respective sub-container vessels of matching shape carried therein with upper surfaces thereof disposed evenly with the outer surface of the container top, each said sub-container vessel having a radially inward portion thereof being held and protected by the pull tab in its unremoved position, wherein when the pull tab is removed from the container top the sub-container vessels can be removed from their respective exterior wells for dispensing of their respective ingredients.

In a one can container embodiment, the device comprises the container top being formed with an exterior well positioned on a radially spaced side from the pull tab and recessed below the outer surface of the container top, said exterior well having a sub-container vessel of matching shape carried therein with an upper surface thereof disposed evenly with the outer surface of the container top, said sub-container vessel being divided into a plurality of compartments each having a dispensing orifice for dispensing a respective ingredient therefrom, said sub-container vessel having a radially inward portion thereof being held and protected by the pull tab in its unremoved position, wherein when the pull tab is removed from the container top the sub-container vessel can be removed from the exterior well for dispensing of the ingredients from the respective compartments.

With these improved devices, multiple ingredients can be safely stored separately from the carrier liquid and conveniently used and controllably metered into the container according to the user's tastes. Thus, a wide range of new liquid food products can be provided with better flavor, longer shelf life, and using otherwise unstable ingredients, and without any or with reduced amounts of preservatives.

Other objects, features, and advantages of the present invention will be explained in the following detailed description of the invention having reference to the appended drawings.

BRIEF DESCRIPTION OF DRAWINGS

FIGS. 7A through 7H illustrate a sixth embodiment of the invention having a sub-container vessel with multiple compartments held in an exterior well recessed in the outer surface of a fixed container top, which is held in place and protected by a container pull-tab.

DETAILED DESCRIPTION OF INVENTION

Figure 1A:
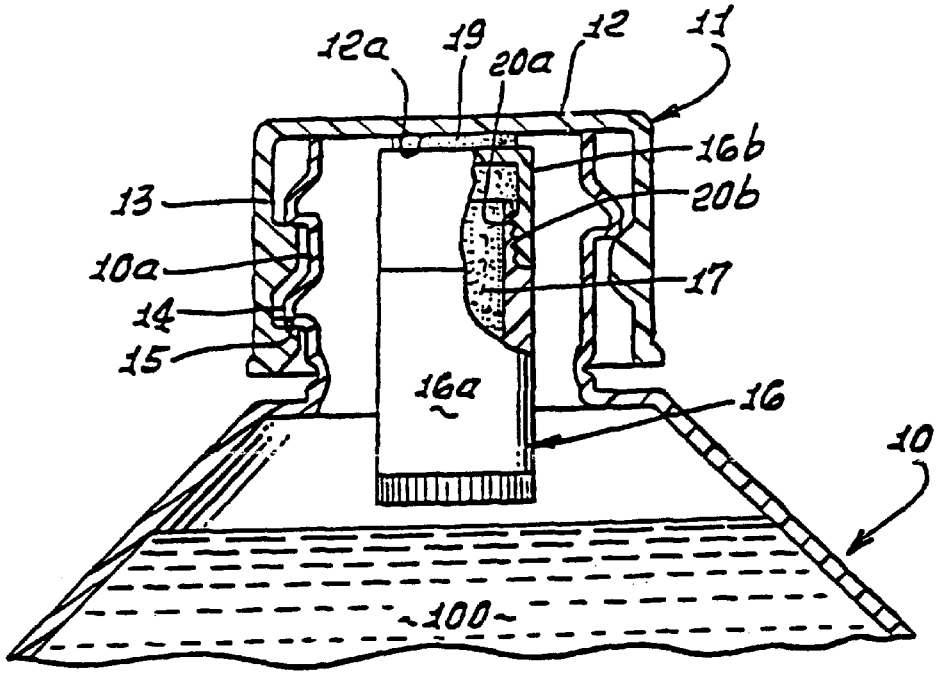
FIG. 1A (PRIOR ART)
FIGS. 1A and 1B illustrate two versions of a prior art device having a sub-container body with one or two compartments mounted to a container cap or held on a container neck by the container cap.
Figure 1B:
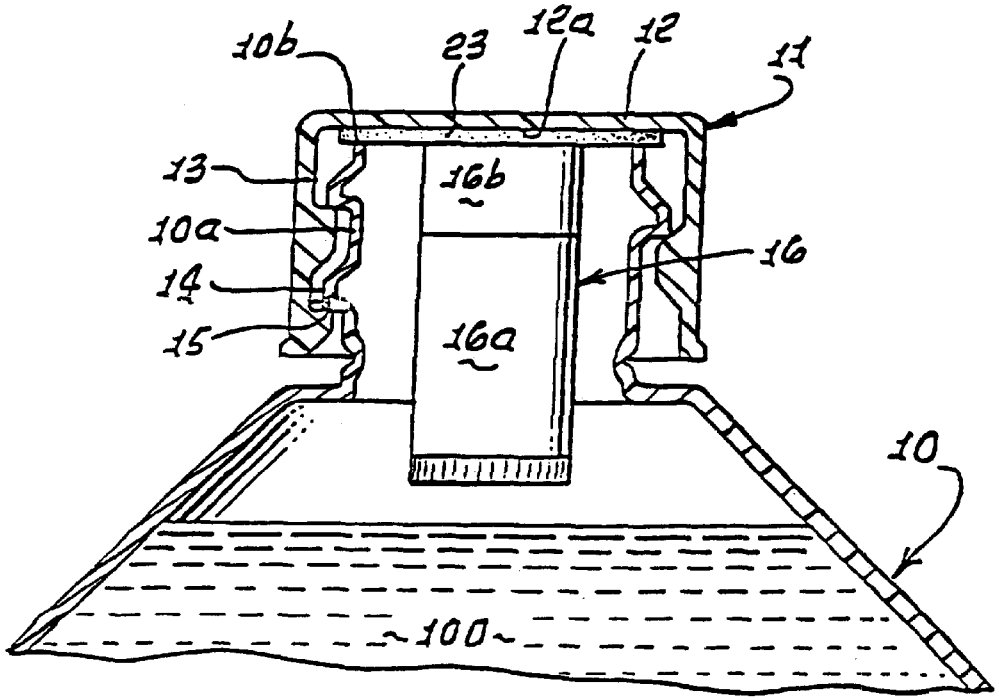
FIG. 1B (PRIOR ART)

A broad objective of the present invention is to overcome the disadvantages of the prior art devices, as represented in FIGS. 1A and 1B. In FIG. 1A, a container 10 holding a liquid 100 has a neck 10*a* and a cap 11 with upper wall 12 and depending skirt 13. The cap is applied on the neck to close the container by threading the inter-engaging threads 14 and 15. A rigid sub-container 16 has a lower portion 16*a* containing a dry ingredient 17 that is held, through inter-engaging threads 20*a* and 20*b*, to an upper closure portion 16*b* fixed to the underside 12*a* of the cap 11 by an adhesive layer 19. When the cap is removed from the container, the lower portion 16*a* of the sub-container body can be un-threaded from the fixed upper portion 16*a* and its ingredient can be dispensed into the liquid 100. In another version shown in FIG. 1B, the sub-container body 16 is held on the cap on the container neck suspended by a collar 23, and has separate compartments 16*a* and 16*b* which are opened by unthreading them from each other. This type of prior art device is costly to manufacture and inconvenient to use.

In accordance with one principal approach in the present invention, a device for storing ingredients separately within a container has a sub-container body held by a container cap, such as is commonly used for a beverage bottle, which has squeezable plastic outer walls and inner divider walls forming multiple compartments with respective orifices for dispensing ingredients contained therein. Each compartment can be separately opened (by removing a sealing element) and its ingredient can be dispensed into the container by squeezing on corresponding portions of the outer walls. Four embodiments of this approach are described below.

In another principal approach, the device has a plurality of sub-container vessels or a single vessel with multiple compartments held in exterior well(s) recessed in a fixed container top, such as is commonly used for a beverage can. The sub-container vessels are held in place by and protected by the pull tab on the container top. When the pull tab is removed and the tab opening is exposed, the sub-container vessels can be removed from the exterior wells to dispense their separate ingredients into the container. Two embodiments of this approach are described below.

Figure 2A:
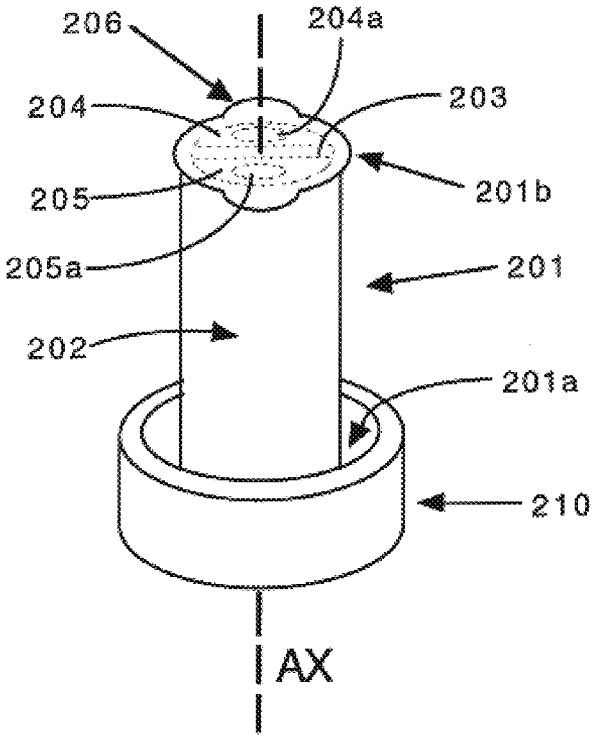
FIGS. 2A through 2G illustrate a first embodiment of the invention having a multi-compartment sub-container body with squeezable plastic, outer cylindrical walls, which is mounted to the container cap.
Figure 2B:
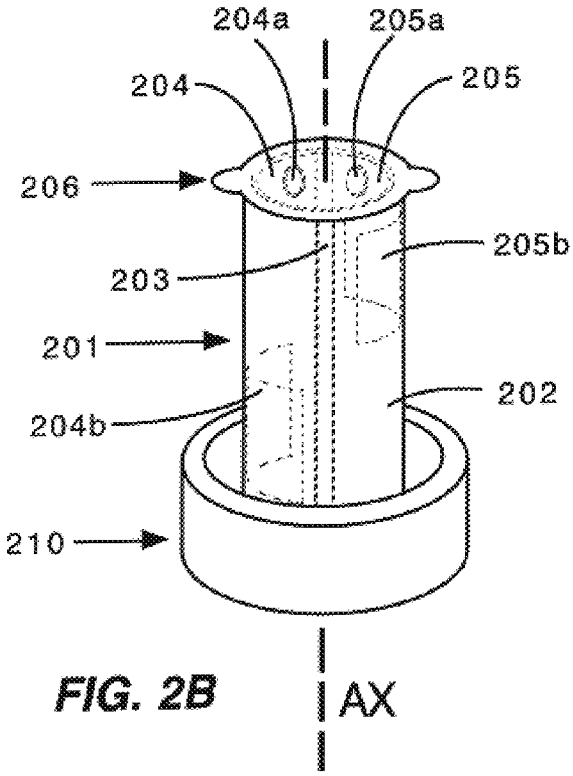

Referring to FIGS. 2A and 2B, a first embodiment of the device for use with a bottle container has a sub-container body 201 in cylindrical form with a proximate end 201*a* mounted to the underside of the container cap 210. The sub-container body 201 has squeezable plastic outer walls 202 and at least one inner divider wall 203 which is aligned in parallel with a cylinder axis AX of the sub-container body. The divider wall 203 divides the interior of the sub-container body into two axially oriented compartments 204, 205. A greater number of compartments can be formed by using more than one divider wall.

The compartments 204, 205 are used to contain respective flavorings, oils, vitamins, supplements, medicines, and other ingredients to be mixed in the carrier liquid at the time of use. The compartments have respective dispensing orifices 204*a* and 205*a* formed through closure walls at the distal end 201*b* of the sub-container body. The orifices of the individual compartments are sealed with individual adhesive foil tabs 204*c* and 205*c*. The distal end of the sub-container body 201 is sealed by a removable adhesive film membrane 206 with pull tabs to protect the foil tabs covering the orifices.

Figure 2C:
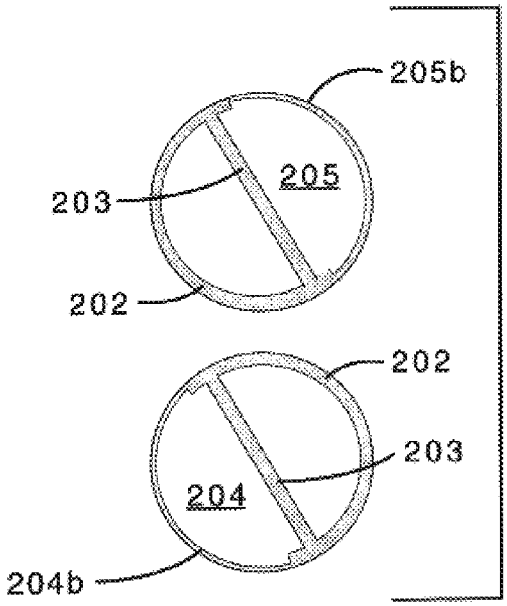

As shown in FIGS. 2B and 2C, predetermined portions 204*b* and 205*b* of the outer cylindrical walls 202 corresponding to the respective compartments are formed with a lesser wall thickness than the surrounding wall portions. The thinner wall areas can be squeezed more readily to dispense ingredients contained in the respective compartments, as illustrated in FIG. 2G. The combination of a readily manipulable squeezing area and dispensing orifice allows the user to controllably dispense the ingredient from the respective compartment.

Figure 2D:
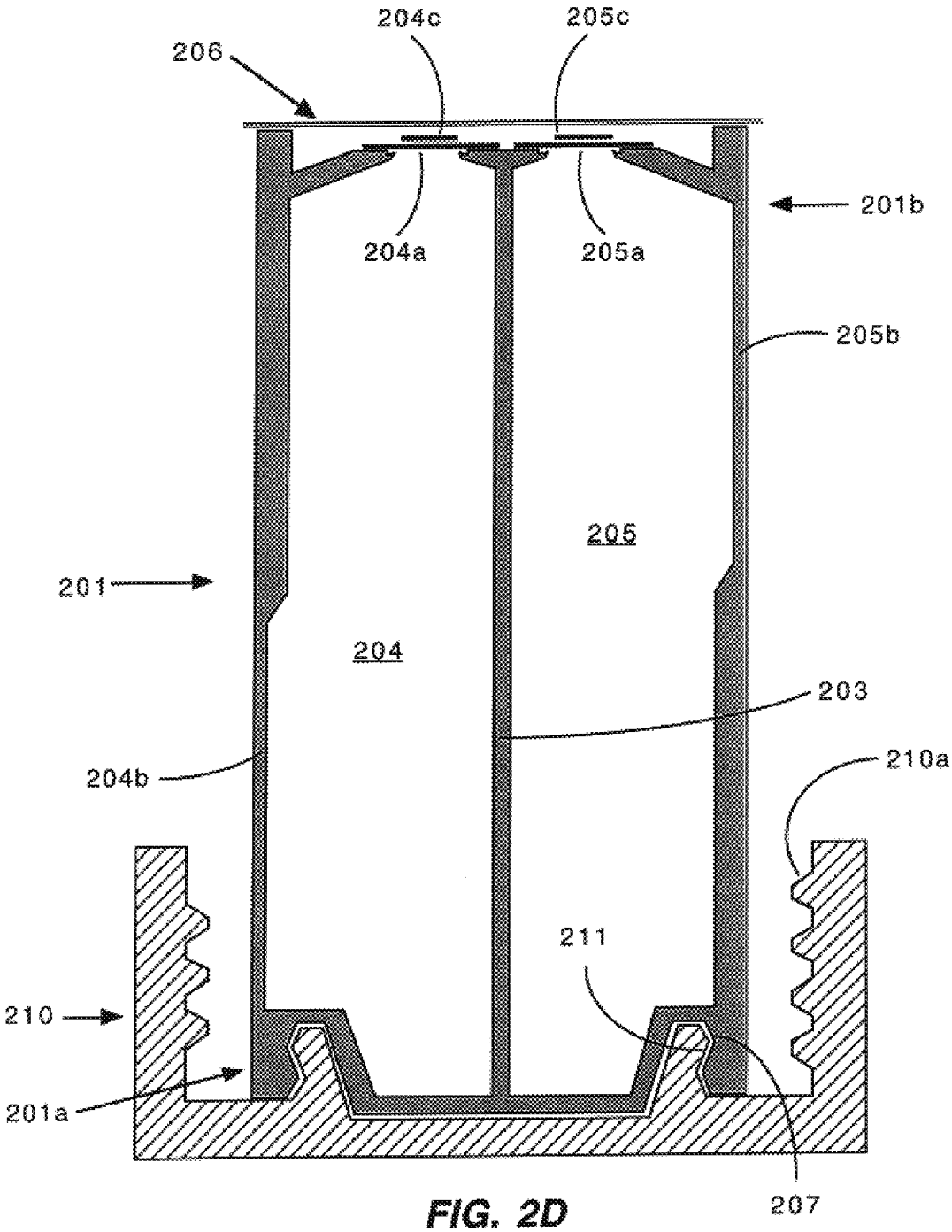
Figure 2E:
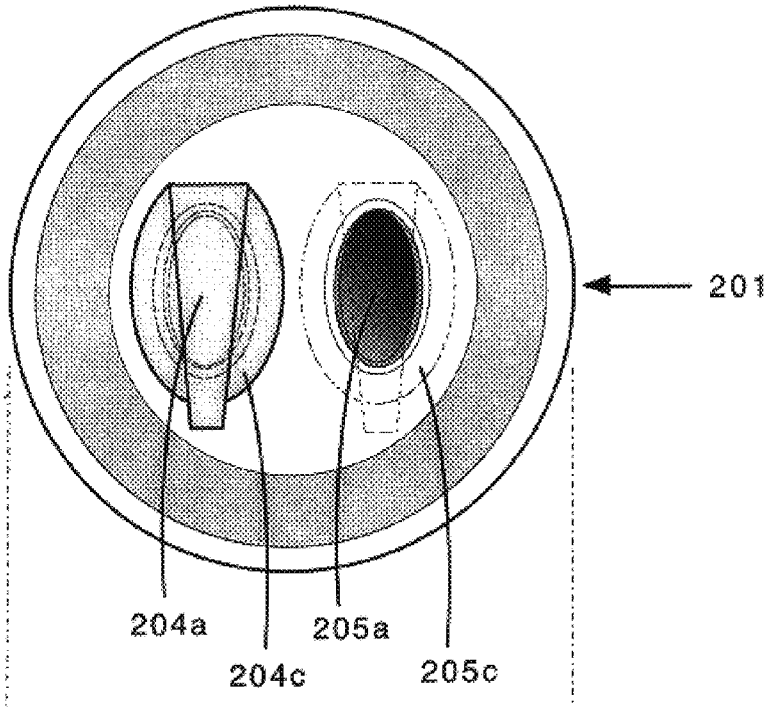
Figure 2F:
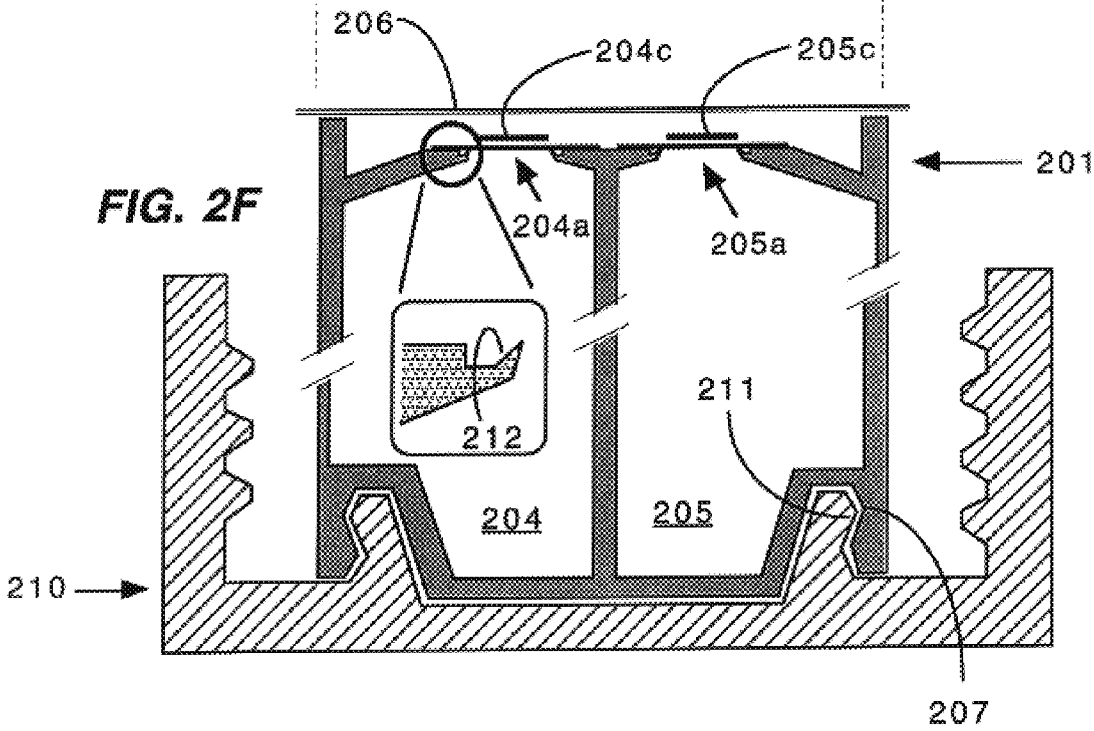
Figure 2G:
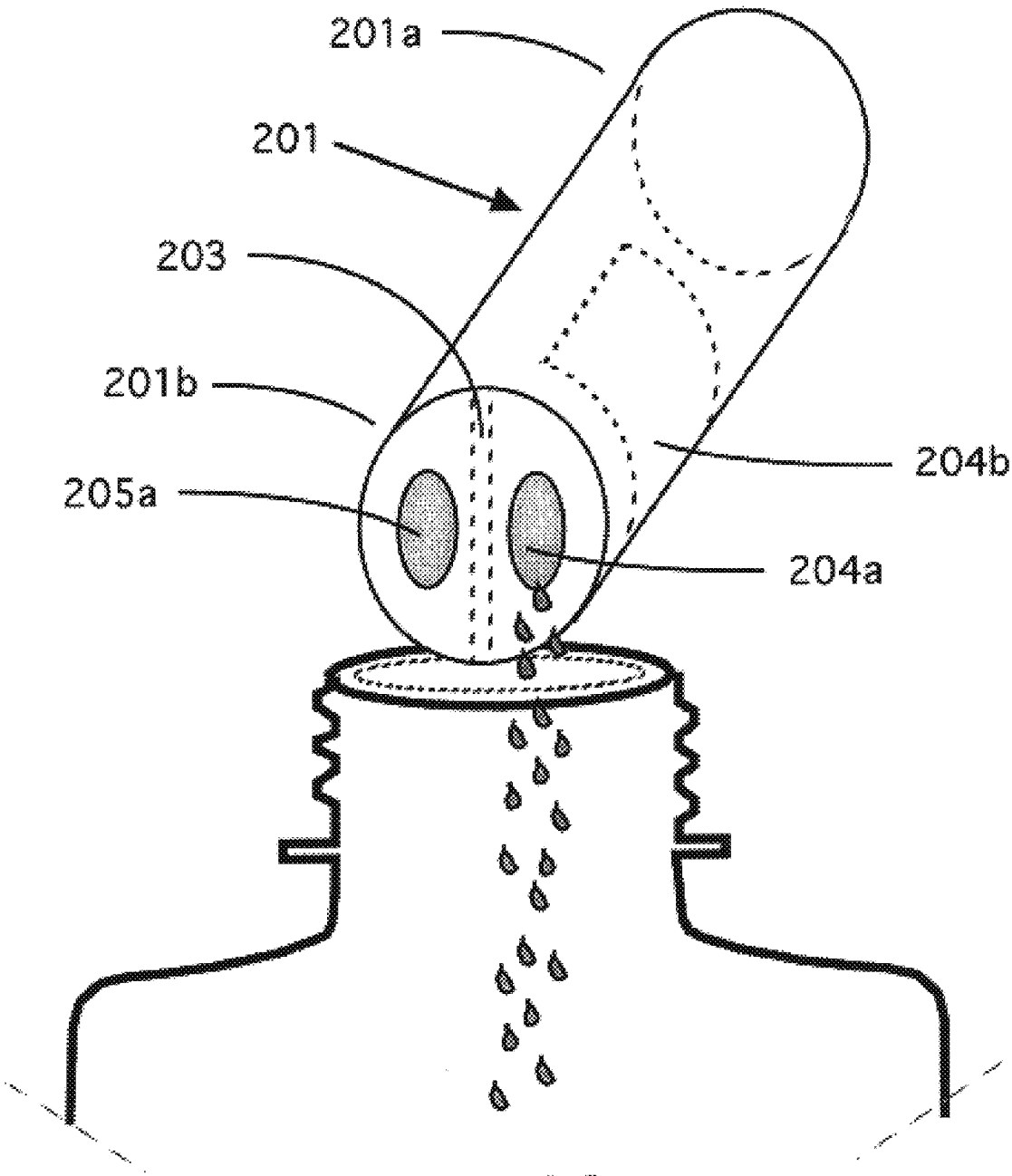

In further details shown in FIGS. 2D, 2E, and 2F, the sub-container body 201 is mounted at its proximate end 201*b* to the underside of the cap 210, which may be accomplished by any suitable means. In this embodiment, the sub-container body has a indented portion 207 with a detent surface and the cap 210 has a projection 211 with a detent-engaging surface for snap-fitting the sub-container body to the cap. This allows the parts to be molded separately, and also gives the user the option of removing the sub-container body from the cap to dispense ingredients and/or to reclose the cap. The cap 210 has threads 210*a* for threading on the neck of the container. The orifices 204*a* and 205*a* are sealed with individual foil tabs 204*c* and 205*c*. The annular edges of the orifices 204*a* and 205*a* may be provided with anti-drip indentations 212 which hold back any residue ingredient drips after pressure on the compartment is released.

The sub-container body can be made of clear polyvinylchloride (PVC), polypropylene (PP), or other suitable plastic material that is durable and has sufficient flexibility to allow it to be elastically squeezed. Typical overall wall thickness is in the range of about 0.50 mm, and about 0.20 mm for the thinner-walled portions. The dimensions of the sub-container body may be varied depending on the size of the cap, container, and desired holding capacity for the ingredients. For a bottle cap of typical 35 mm diameter, the sub-container body can have a diameter of about 22 mm. The orifice preferably have an elliptical shape with dimensions of about 3 mm by 5 mm.

Figure 3A:
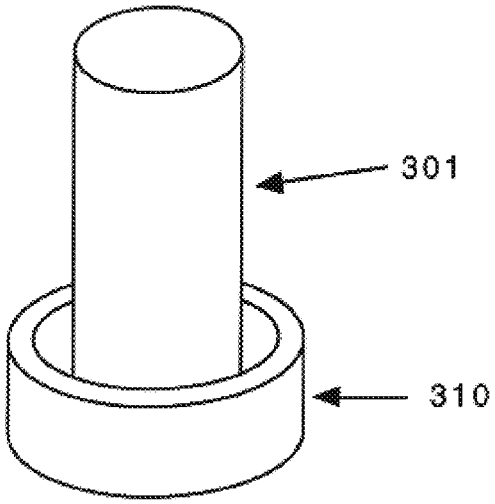
FIGS. 3A through 3E illustrate a second embodiment of the invention having a multi-compartment sub-container body with squeezable plastic, outer cylindrical walls, which is detachably removable from the container cap.
Figure 3B:
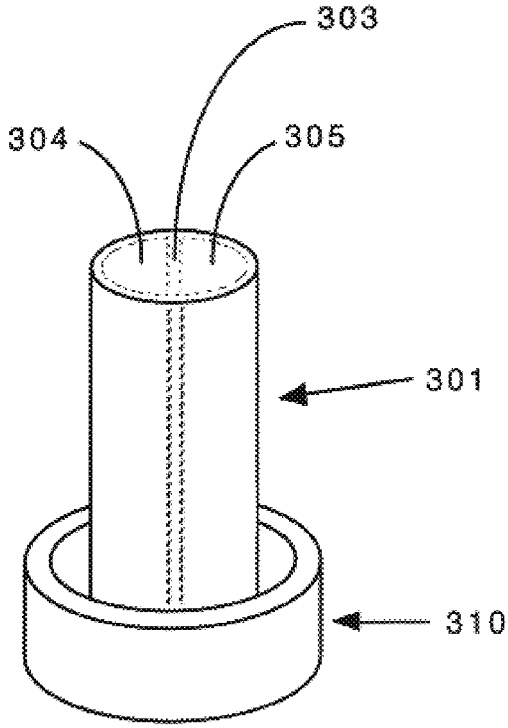
Figure 3C:
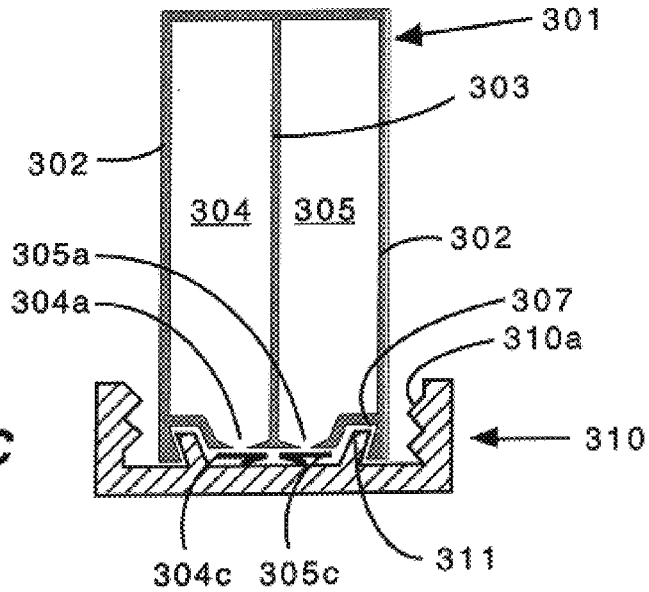
Figure 3D:
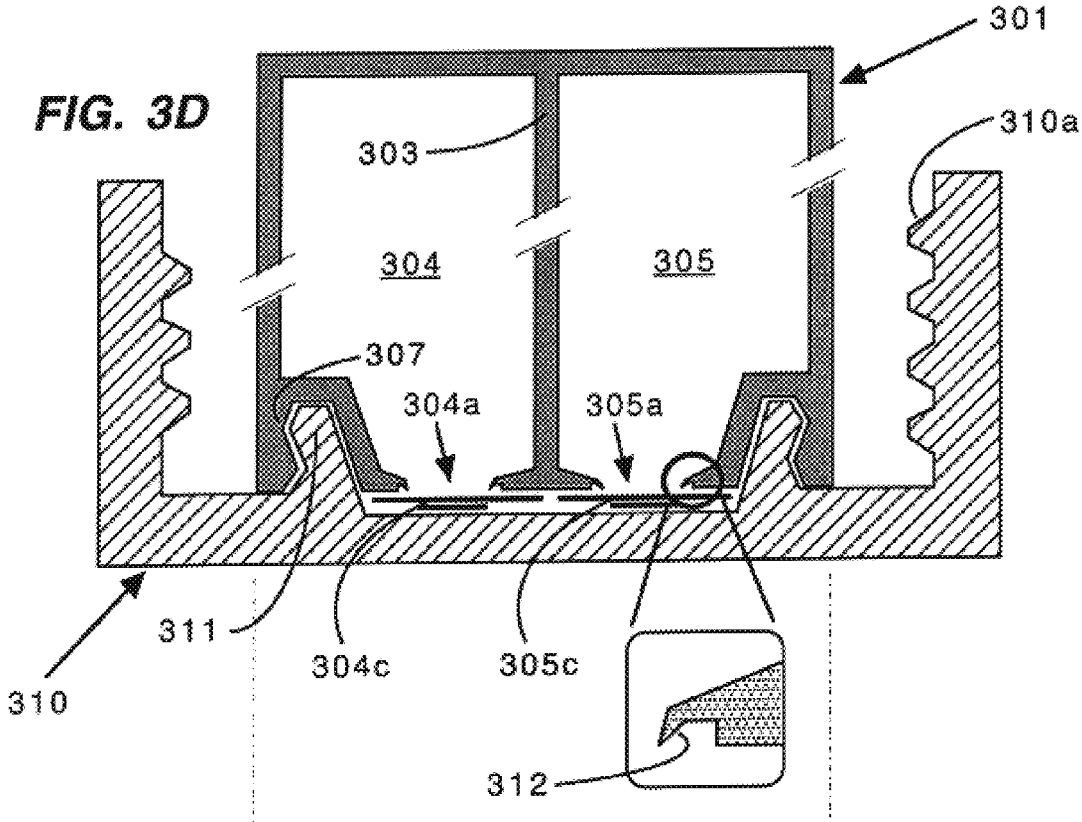
Figure 3E:
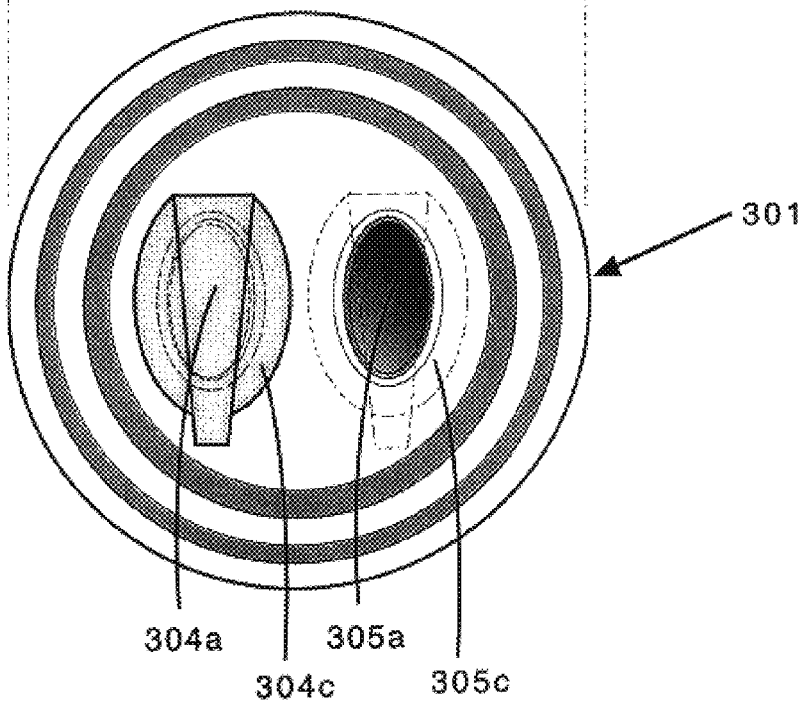

In FIGS. 3A, 3B, and 3C, a second embodiment of the device is shown having a cylindrical sub-container body 301 with its proximate end detachably mounted to the underside of the container cap 310 by detent surfaces 307 snap-fitted onto projections 311 on the underside of the cap. The sub-container body 301 has squeezable plastic outer walls 302. The divider wall 303 divides the interior of the sub-container body 301 into compartments 304 and 305. The compartments 304 and 305 have respective dispensing orifices 304*a* and 305*a* formed at the proximate end of the sub-container body. As shown in more detail in FIGS. 3D and 3E, the orifices are sealed with removable sealing tabs 304*c* and 305*c*, and have anti-drip edges 312. In this embodiment, positioning the compartment orifices at the proximate end keeps them away from the carrier liquid and reduces the possibility of seepage or liquid penetration into the seals.

Figure 4A:
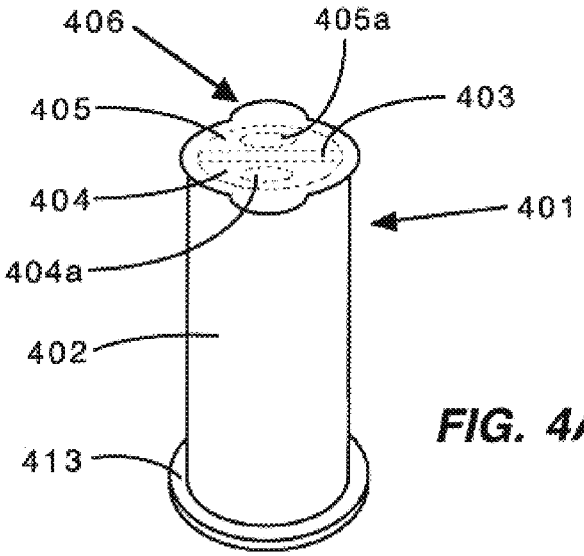
FIGS. 4A through 4F illustrate a third embodiment of the invention having a multi-compartment sub-container body with squeezable plastic, outer cylindrical walls, which is mounted by the container cap on a container neck.
Figure 4B:
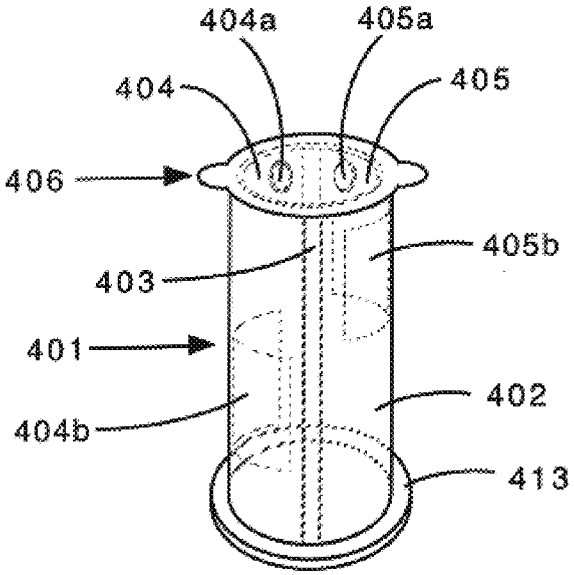
Figure 4C:
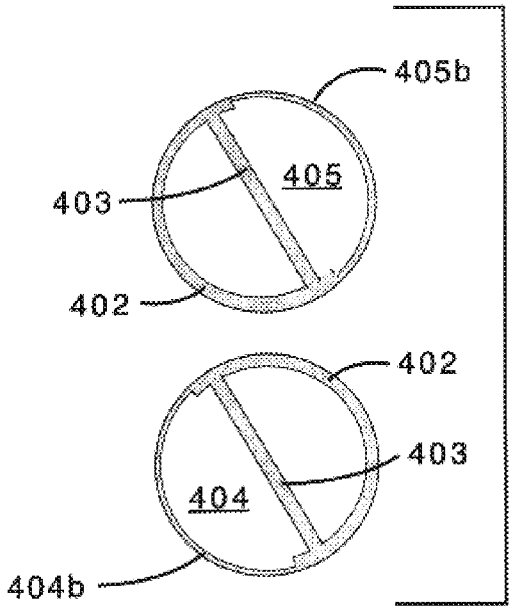
Figure 4D:
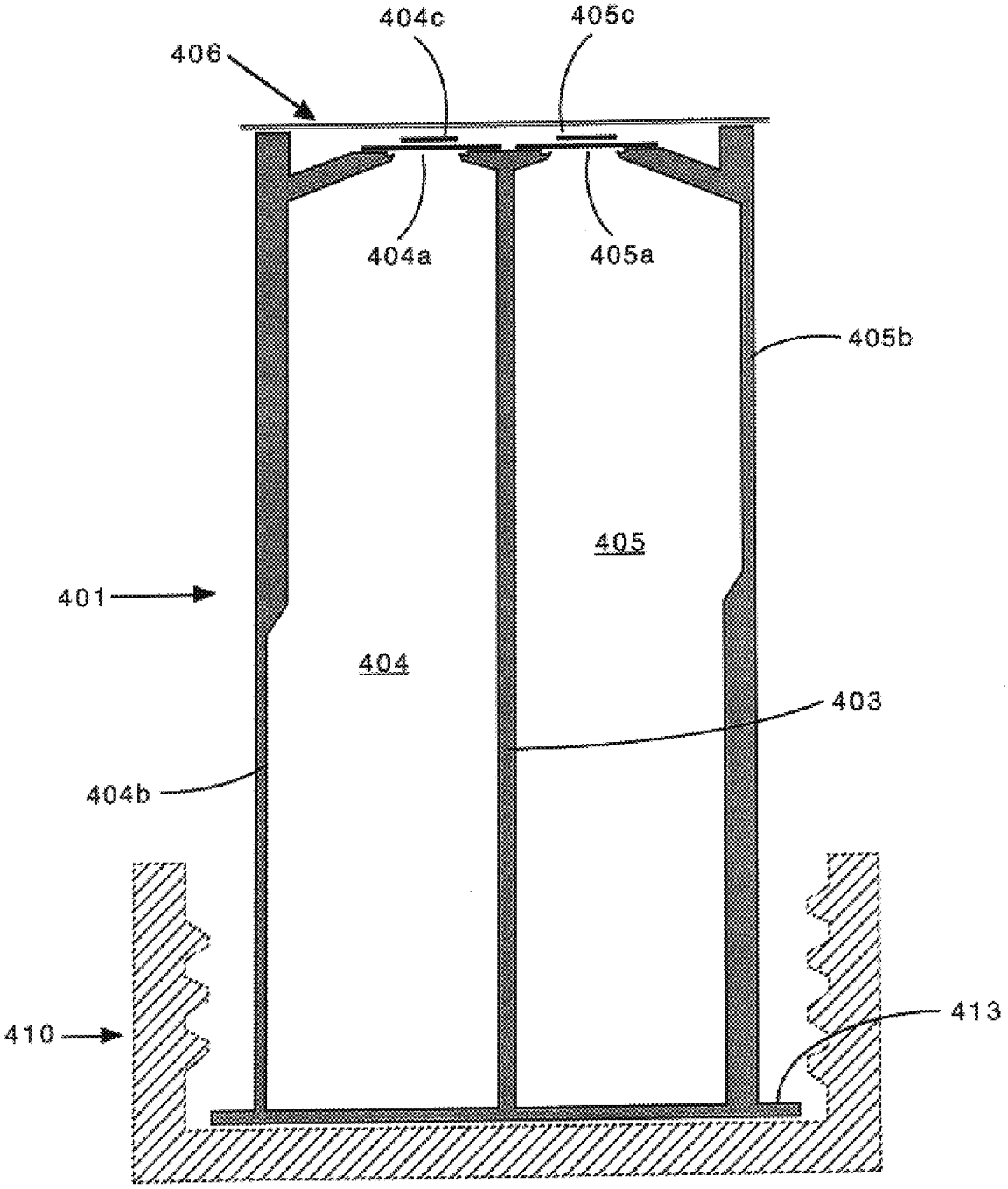
Figure 4E:
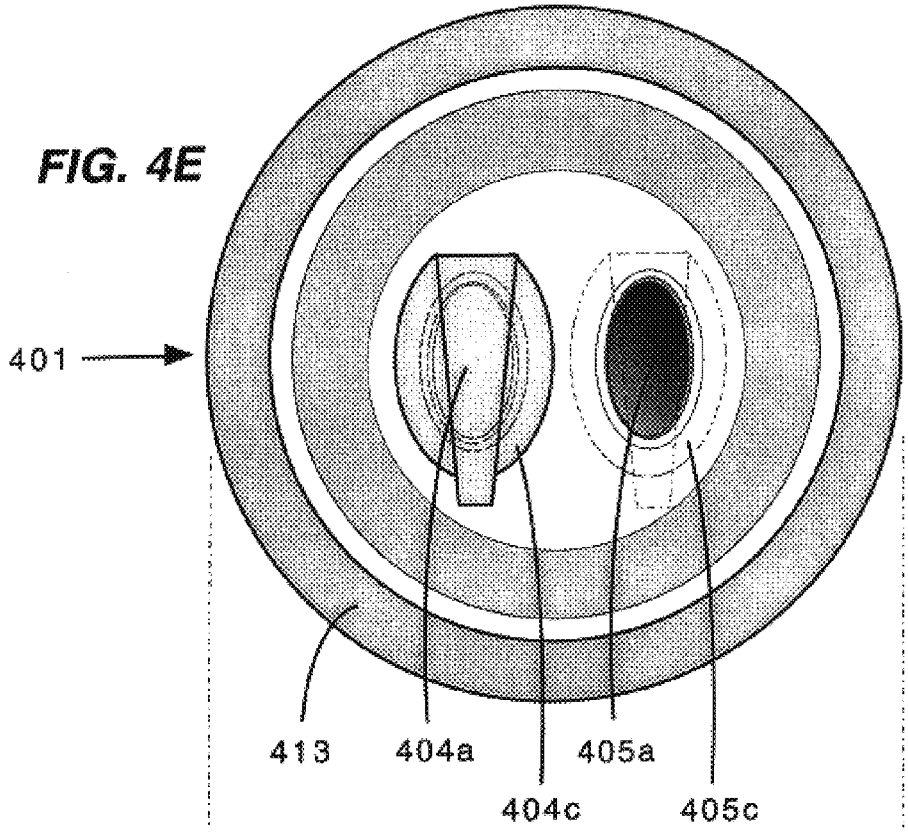
Figure 4F:
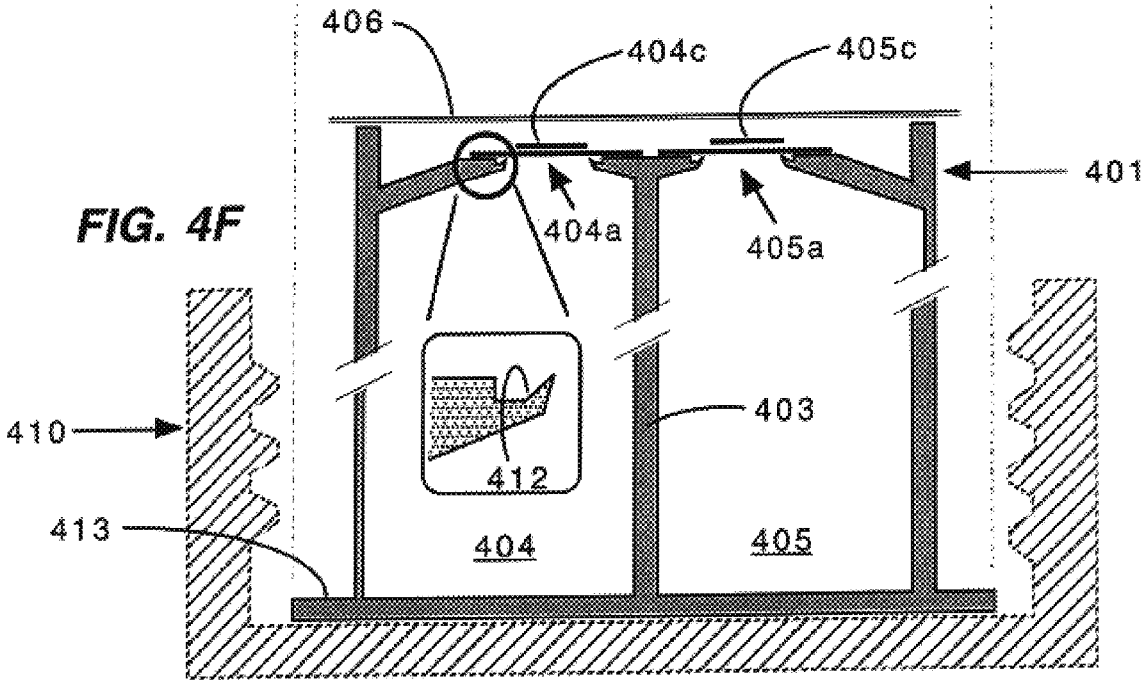

In FIGS. 4A, 4B, and 4C, a third embodiment of the device, similar to the first embodiment, has a cylindrical sub-container body 401 formed with squeezable plastic outer walls 402, divider wall 403, compartments 404 and 405, respective orifices 404*a* and 405*a* at its distal end, and thin-walled squeeze portions 404*b* and 405*b*. In FIG. 4D, the sub-container body 401 is shown fixed to a collar 413 which is to be held on the container neck by the container cap 410 (in a manner similar to the prior art device of FIG. 1B). When the cap is removed from the container neck, the sub-container body 401 can be lifted out and the orifices 404*a* and 405*a* unsealed to dispense the respective ingredients. In FIGS. 4E and 4F, the orifices 404*a* and 405*a* for the compartments of the sub-container body 401 are shown having individual sealing tabs 404*c* and 405*c*, anti-drip edges 412, and outer sealing membrane 406.

The sub-container body 401 has a diameter which easily fits within the bottle neck opening, while the collar has a diameter large enough to fit within the inside of the cap and rest on the upper rim of the neck. The collar can be made of a rigid plastic such as high density polyethylene.

Figure 5A:
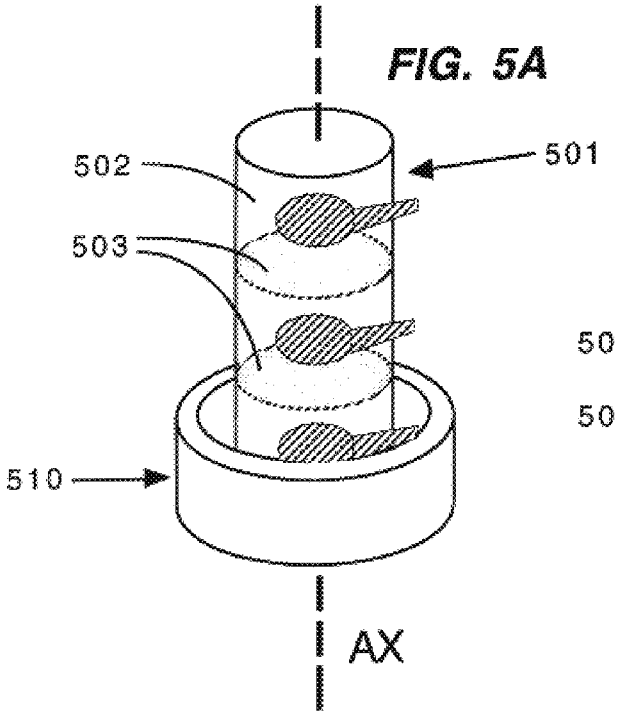
FIGS. 5A through 5G illustrate a fourth embodiment of the invention having a sub-container body with multiple compartments arranged transversely, which is mounted to the container cap.
Figure 5B:
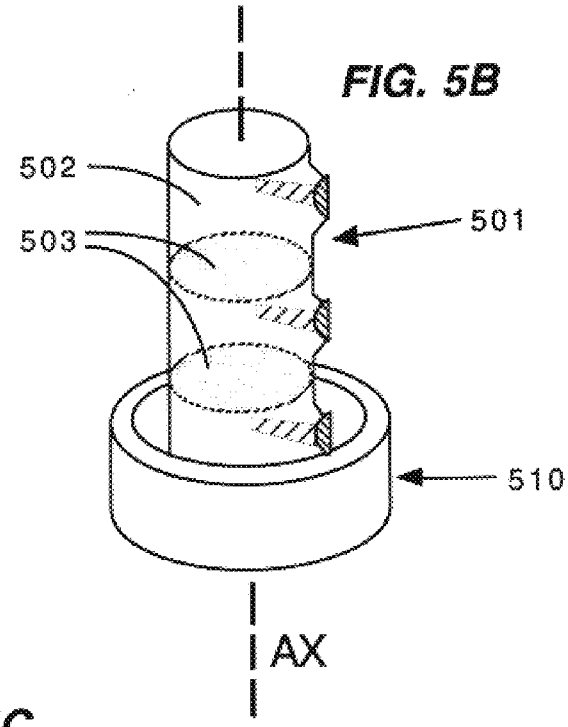
Figure 5C:
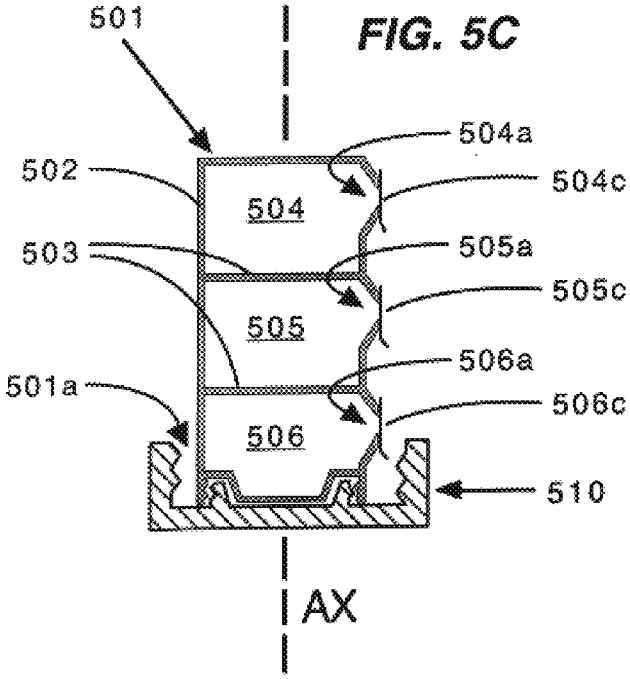

In FIGS. 5A, 5B, and 5C, a fourth embodiment of the device is shown having a sub-container body 501 in cylindrical form with its proximate end 501*a* mounted to the underside of the container cap 510. The sub-container body is formed with squeezable plastic outer walls 502, and has divider walls 503 aligned transverse to the cylinder axis AX dividing the interior of the sub-container body into a plurality of transversely oriented compartments 504, 505, and 506. The compartments have respective orifices 504*a*, 505*a*, and 506*a* formed at predetermined positions of the outer walls for each compartment.

Figure 5D:
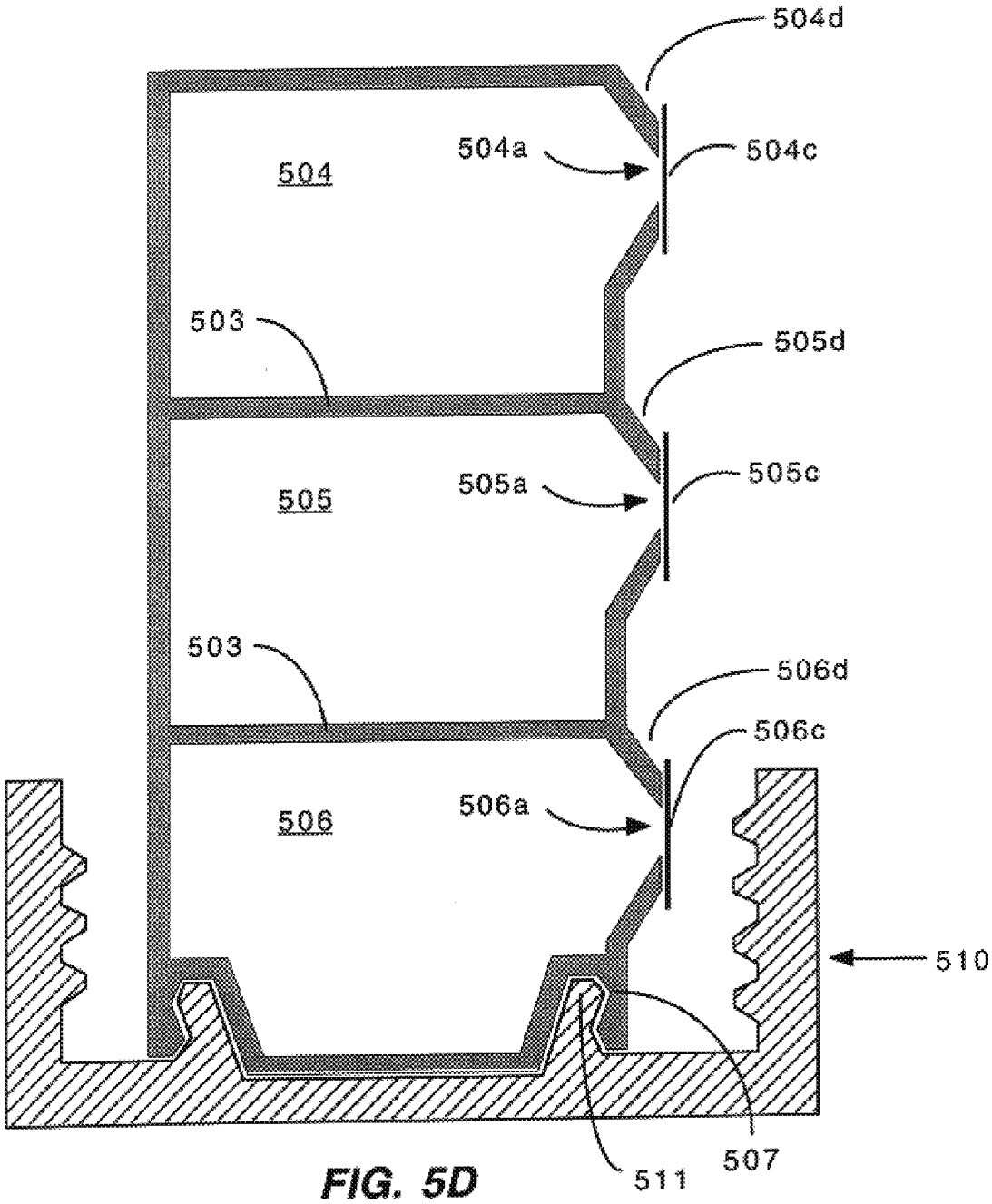
Figure 5E:
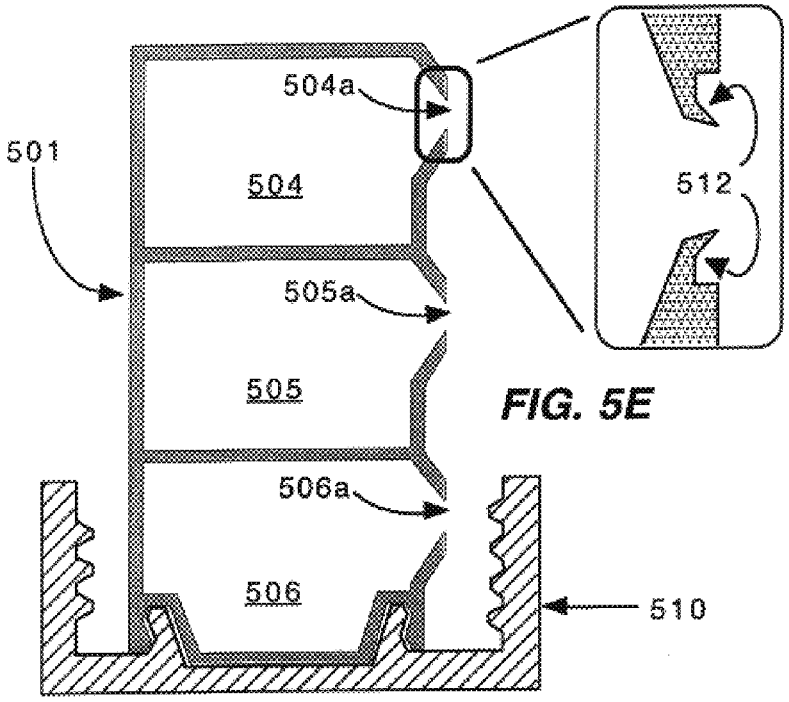
Figure 5F:
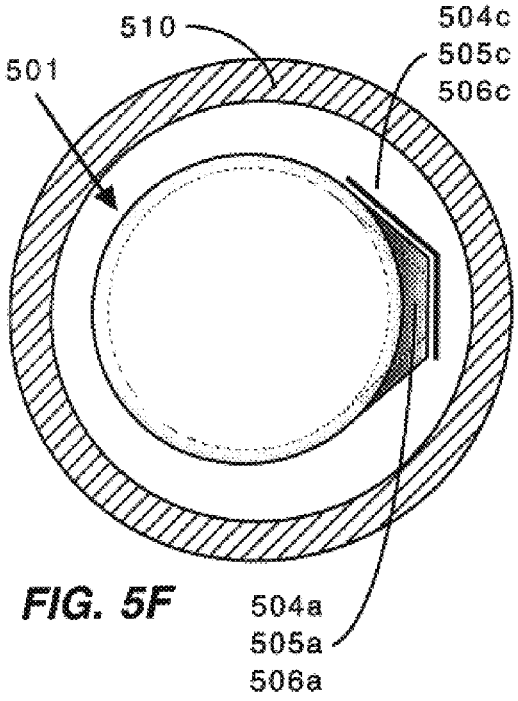
Figure 5G:
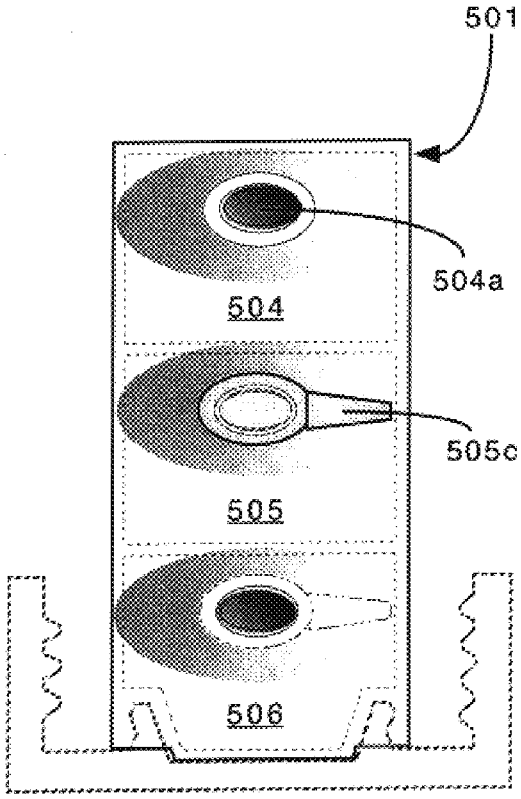

In FIG. 5D, the sub-container body 501 is shown in greater detail having an indented detent surfaces 507 to which projections 511 on the underside of the cap are snap-fitted to mount the sub-container body to the cap. The portions of the outer walls at the positions of the orifices can be formed with puckers 504*d*, 505*d*, and 506*d* for better directing of ingredients from the orifices under pressure. In FIG. 5E, the orifices 504*a*, 505*a*, and 506*a* are shown having anti-drip edges 512. FIGS. 5E, 5F, and 5G show in greater detail the orifices sealed by individual, removable sealing element 504*c*, 505*c*, and 506*c*.

The sub-container body in the three-compartment example described above can have typical dimensions of about 20 mm diameter (excluding the puckered areas around the orifices) and 45 mm length, resulting in each of the three compartments having about 4.7 cc capacity. The sub-container body may be formed with any desired number of separate compartments for the ingredients by providing the required number of divider walls. For an example where it is used for iced coffee beverage, it can have three divider walls forming four compartments to hold coffee flavoring, creamer, sugar, and synthetic sweetener.

Figure 6A:
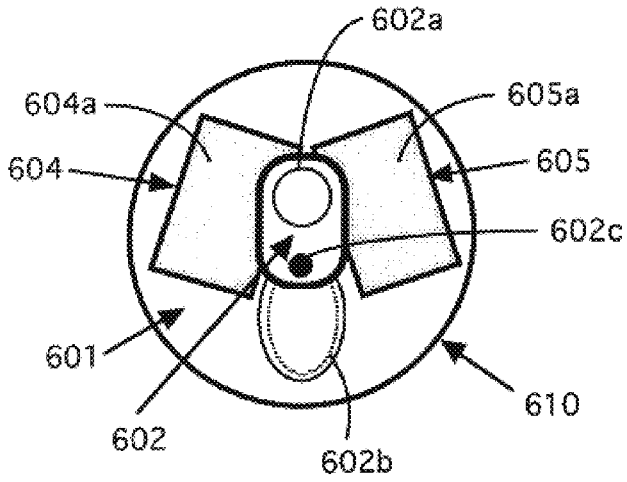
FIGS. 6A through 6D illustrate a fifth embodiment of the invention having multiple sub-container vessels held in exterior wells recessed in the outer surface of a fixed container top, which are held in place and protected by a container pull-tab.
Figure 6B:
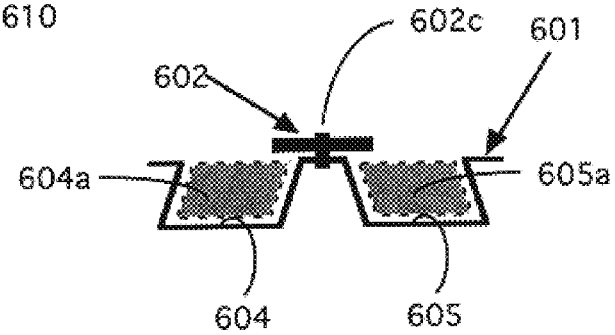
Figure 6C:
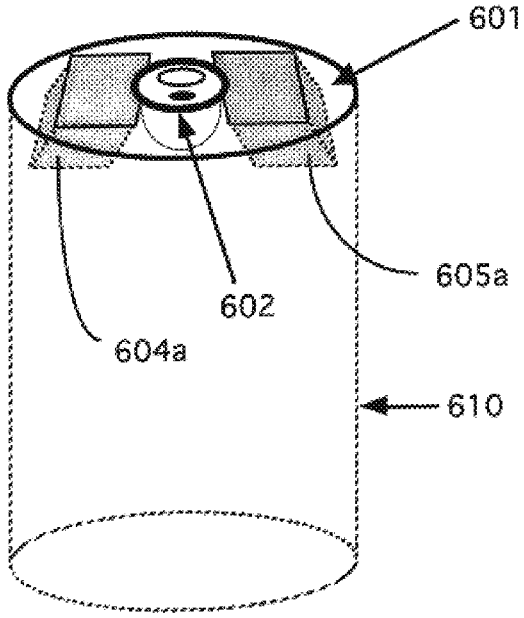

A fifth embodiment of the invention, as illustrated in FIGS. 6A, 6B, and 6C, is used with a container 610 with a fixed container top 601, such as for a beverage can. The container top 601 has an outer surface fitted with a pull-tab 602 having a pull portion 602*a*, a tab portion 602*b*, and a center fixture 602*c* which is detachably mounted to a center position on the outer surface of the container top. A tab opening formed in the container top is removably covered by the tab portion 602*b* of the pull-tab. Two (or more) exterior wells 604 and 605 are arranged at positions radially spaced from the pull tab 602 and are recessed below the outer surface of the container top 601.

Figure 6D:
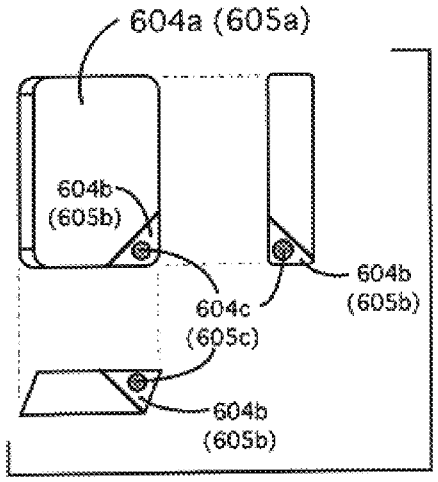

The exterior wells have respective sub-container vessels 604*a* and 605*a* of matching shape carried therein with their upper surfaces disposed evenly with the outer surface of the container top. FIG. 6D shows each sub-container vessel 504*a* (505*a*) having a dispensing orifice 604*c* sealed by a sealing element 604*b*. When the sub-container vessels are positioned in their exterior wells, a radially inward portion thereof is covered and held in place by a portion of the pull tab 602 in its unremoved position. When the pull tab is removed from the container top, the sub-container vessels can be removed from their respective exterior wells for dispensing of the respective ingredients into the container tab opening.

The sub-container vessels are formed with squeezable plastic outer walls, as previously described, to allow pressure to be applied to dispense the contents. For typical beverage cans having a can top of about 60 mm, the exterior wells can have a width of about 15 mm, spaced about 8 mm in the radial direction from the center position of the pull tab, a length of about 25 mm, and a depth of from 8 to 12 mm, resulting in each vessel having a capacity of about 3.7 to 4.0 cc. The interior walls of the exterior wells opposite their open end can be formed at varied depths to vary the volume of each of the wells. The walls of the exterior wells can be slanted towards the center position of the pull-tab to bias the vessels toward the pull tab and prevent them from being accidentally dislodged from the wells during handling.

In production on a form/fill/seal line, the container top is fabricated with the exterior wells press-formed therein, and with the tab portion scored in the tab opening and the mounting fixture for the pull portion riveted to the center of the top. The top is crimp-rolled onto the container body with the liquid media filled therein. The sub-container vessels can be inserted in the exterior wells by rotating the pull portion of the pull-tab about its center fixture to clear the openings of the wells. After the vessels are inserted therein, the pull portion is rotated back to its original position to overlap the openings of the wells and hold and protect the vessels therein. A protective paper, plastic, or nonwoven substrate may be placed over the container top and under the pull portion (usable also for printed advertising and by the user as an absorbent surface).

Figure 7F:
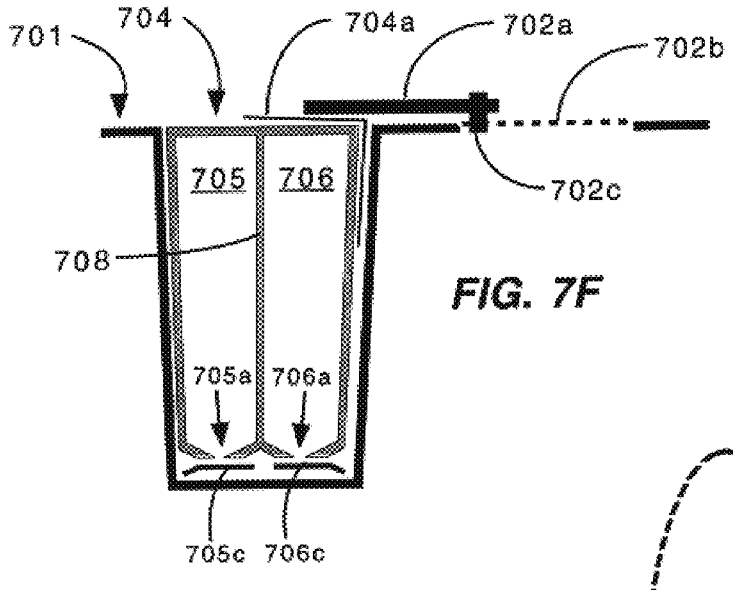
Figure 7G:
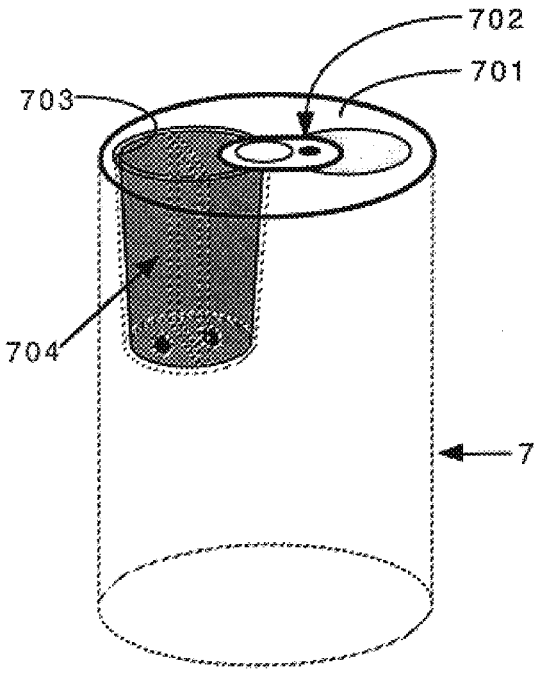

In FIGS. 7A, 7B, and 7C, a sixth embodiment of the device for use with a container can has an exterior well 703 recessed in the outer surface of the container top 701 of the container 710. The pull-tab 702 has a pull portion 702*a*, tab portion 702*b*, and center fixture 702*c* detachably mounted to a center position of the container top. In its unremoved position, the pull portion 702*a* of the pull-tab 702 overlaps partially the opening of the exterior well 703, and the tab portion 702*b* seals a tab opening 702*b*' in the container top.

As shown in FIGS. 7D, 7E, 7F, and 7G, a sub-container vessel 704 of matching shape is adapted to be carried in the exterior well 703 with its upper surface disposed evenly with the outer surface of the container top 701. As described for the earlier embodiments, the sub-container vessel has squeezable plastic outer walls and at least one inner divider wall 708 dividing its interior into compartments 705 and 706. The compartments have respective dispensing orifices 705*a* and 706*a* formed at the lower end of the vessel, which is not exposed at the surface when the vessel is seated in the exterior well. The orifices are sealed by individual, removable sealing tabs 705*c* and 706*c*.

Figure 7H:
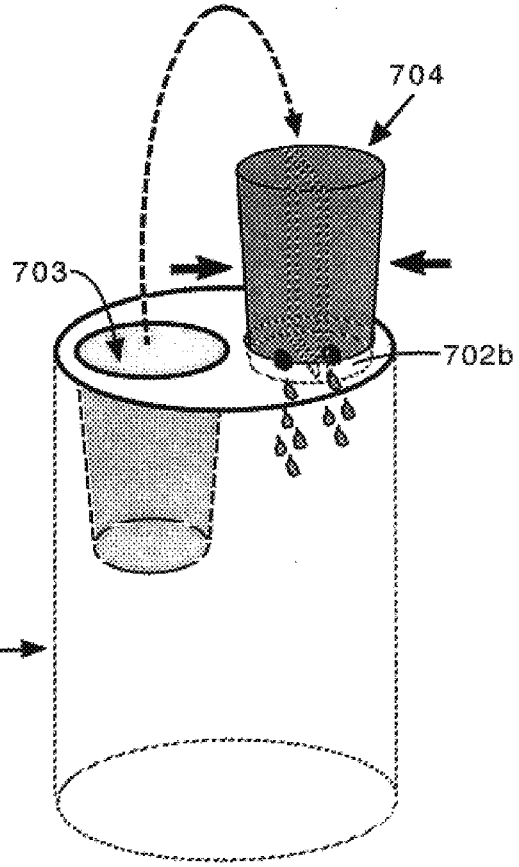

For use, as shown in FIG. 7H, when the pull-tab is removed, the vessel 704 can be removed from the exterior well 703 (by pulling on a tab 704*a*), and ingredients can be dispensed from the respective compartments by removing the sealing tabs 705*c* and 706*c* and squeezing on respective portions of the outer walls corresponding to the compartments (outlined arrows in FIG. 7H). The vessel may have thinner wall portions for the compartments, as previously described, to facilitate controllable dispensing of the respective ingredients. The exterior well can have side walls that incline outwardly to facilitate removal of the vessel, particularly if it has a depth longer than the width of the opening. For a typical beverage can having a can top of about 60 mm diameter, the exterior well can be radially spaced about 7 mm from the center position of the pull tab, and have dimensions of about 24 mm diameter at the top and a variable depth of from 10 to 40 mm. Inserting the vessel in the well is accomplished in the same manner previously described.

With these improved devices, multiple ingredients can be safely stored separately from the carrier liquid and conveniently used and controllably metered to the user's tastes. The device structures can be manufactured using standard plastic molding or extrusion production, lamination, filling, and sealing techniques at relatively low cost. The multiple compartments provided by the devices allow a wide range of ingredients to be stored separately and added at the time of use, thereby increasing the types of products that can be produced and marketed, and accommodating a greater range of consumer choices and tastes.

For beverages, sauces, and condiments having high sugar content which might otherwise ferment, the ingredients can be kept separate and mixed in the liquid media at the time of use, thereby allowing the product to be packaged without the need for preservatives. The taste of such products can be improved by keeping flavorings separate until ready to use and by lower levels or elimination of preservatives. Such products can also be exported to countries which have strict controls on the use of preservatives.

A wide range of new liquid food products can be introduced to the marketplace where previously the ingredients might be unstable or become deteriorated when stored with oxygenated water, soda, and other liquid media. Health products using oxygenated water can thus be handled in mass market packaging, shipping, and vending environments.

The multiple compartments of the new device would also allow a variety of flavors to be delivered with a packaged beverage product and allow the user to select the one or ones they prefer. This would allow the manufacturer to produce and ship only one product to the market in place of multiple products that would incur multiplied production, shipping, handling, storage, and stocking costs.

It is to be understood that many modifications and variations may be devised given the above description of the principles of the invention. It is intended that all such modifications and variations be considered as within the spirit and scope of this invention, as defined in the following claims.

I claim:

1. A device for maintaining ingredients separately in a container comprising:

the container having a fixed container top and a pull-tab with a pull portion, a tab portion removably covering a tab opening in the container top, and a center fixture for detachably mounting the pull-tab to an outer surface of the container top, the container top being f formed with at least one exterior well positioned on A radially spaced side from the pull tab and recessed into the outer surface of the container top, said exterior well having a sealed sub-container vessel of matching shape carried therein with an upper surface thereof disposed evenly with the outer surface of the container top, said sub-container vessel being exposed to the outside in the exterior well in the container top and having a radially inward portion thereof which is held and protected by the pull portion of the pull tab in its unremoved position, Wherein when the pull tab is removed from the container top, the su-container vessel can be removed from the exterior well for unsealing and dispensing of an ingredient contained therein.

2. A device according to claim 1, wherein said sub-container vessel is divided into a plurality of compartments each having a dispensing orifice for dispensing a respective ingredient therefrom, said sub-container vessel having a radially inward portion thereof being held and protected by the pull tab in its unremoved position.

3. A device according to claim 2, wherein said sub-container vessel has a shape elongated in a depthwise direction of the exterior well, and at least one inner divider wall therein for dividing the vessel into the plurality of compartments.

4. A device according to claim 3, wherein said inner divider wall of said sub-container vessel is aligned parallel to the depthwise direction of the exterior well for dividing the vessel into the plurality of compartments extending in parallel in the depthwise direction, and wherein each compartment has squeezable plastic outer walls and a dispensing orifice formed at an inner end facing into the exterior well when the vessel is seated in the exterior well.

5. A device for maintaining ingredients separately in a container comprising:

the container having a fixed container top and a pull-tab with a pull portion, a tab portion removably covering a tab opening in the container top, and a center fixture for detachably mounting the pull tab to an outer surface of the container top, wherein the container top is formed with a plurality of exterior wells positioned on radially spaced sides from the pull tab and recessed into the outer surface of the container top, said exterior wells having a plurality of sub-container vessels of matching shape respectively carried therein with upper surfaces thereof disposed evenly with the outer surface of the container top, each said sub-container vessel being exposed in the exterior well in the container top and covered only at a radially inward portion thereof which is held and protected only by the pull portion of the pull tab in its unremoved position, wherein when the pull tab is removed from the container to the sub-container vessels can be removed from the exterior wells for dispensing of respective ingredients contained therein, wherein said sub-container vessels are each formed with squeezable plastic outer walls and a dispensing orifice at a radially inward end of its upper surface, said dispensing orifice being positioned to be overlapped by the pull portion of the pull tab in its unremoved position.

* * * * *